United States Patent [19]

Santo

[11] Patent Number: 4,739,530

[45] Date of Patent: Apr. 26, 1988

[54] FLOATATION SLEEP SYSTEM INCLUDING A RECTILINEAR PERIMETER AIR CHAMBER

[76] Inventor: Philip J. Santo, 12 Mountin Rd., Rochester, N.Y. 14625

[21] Appl. No.: 902,777

[22] Filed: Sep. 2, 1986

[51] Int. Cl.[4] ..... A47C 27/10

[52] U.S. Cl. ..... 5/452; 5/457

[58] Field of Search ..... 5/451, 452, 441, 457, 5/449, 450, 458

[56] References Cited

U.S. PATENT DOCUMENTS

| | | | |
|---|---|---|---|
| 3,251,075 | 5/1966 | Saltness et al. | 5/441 |
| 4,092,750 | 6/1978 | Ellis | 5/451 |
| 4,501,036 | 2/1985 | Santo | 5/452 |

*Primary Examiner*—Alexander Grosz
*Attorney, Agent, or Firm*—Lawrence P. Kessler

[57] ABSTRACT

An improved air chamber for use with a marginal perimeter support adapted to surround and support a fluid-filled bladder of a floatation sleep system. The air chamber comprises an elongated cylinder closed at its ends to form an air-tight chamber. Opposing interior surfaces of the cylinder are interconnected by, for example, tie members extending in a longitudinal direction within said elongated cylinder for less than the full longitudinal dimension of such cylinder. The tie members divide the cylinder into at least three sections located one on top of another, with such sections being in flow intercommunication. Moreover, with this invention, the cross-sectional area of the upper- and lowermost sections may be substantially equal and greater than the cross-sectional area of any intermediate sections. Further, a valve extends through a wall of said elongated cylinder for enabling selective pressurization of the air-tight chamber, whereby under such pressurization the tie members cause the cylinder to assume a substantially rectilinear overall external configuration. A plurality of air chambers can be arranged to form the rectilinear marginal perimeter support for a bladder of a floatation sleep system, with such chambers being readily individually replaced.

11 Claims, 2 Drawing Sheets

FLOATATION SLEEP SYSTEM INCLUDING A RECTILINEAR PERIMETER AIR CHAMBER

BACKGROUND OF THE INVENTION

This invention relates generally to floatation sleep systems including marginal perimeter supporting air chambers, and more particularly to a marginal perimeter supporting air chamber for a floatation sleep system with such chamber having a substantially overall rectilinear shape.

Floatation sleep systems, commonly referred to as waterbeds, have become a popular alternative to conventional bedding. Such popularity is due to the fact that waterbeds provide totally balanced body support by the sleep surface which has been found to induce a superior state of relaxation. The first waterbeds were free standing, flexible bladders filled with water. However, since the free standing bladder was flexible in all directions, it was necessary that it have sufficient vertical dimension (height) to prevent "bottoming out" when a body was supported on the bladder. This height made it awkward to get on and off of the bladder, and the fact that the side walls of the bladder were flexible made sitting on the edge difficult and uncomfortable. Therefore, a rigid frame located around the marginal perimeter edges of the flexible bladder were added. While the frame supported the edges of the bladder so that a sufficient height was maintained in to prevent bottoming out, sitting on the edge of the bladder and getting in and out of the waterbed over the rigid frame was still uncomfortable.

In order to provide the advantages of a rigid frame to the waterbed while improving the comfort thereof, the rigid frame was replaced by a air chamber surrounding the marginal perimeter edges of the flexible bladder (see for example, U.S. Pat. Nos. 3,778,852, issued Mar. 21, 1978 in the name of Penn et al, and 4,070,473, issued Dec. 18, 1983 in the name of Philips). The marginal perimeter air chamber provided the desireable comfort when entering and exiting the waterbed and when sitting on the edge thereof, and in addition supported the marginal perimeter of the bladder at a height which prevented the bladder from bottoming out.

More recently, I have improved the marginal perimeter supporting air chamber type floatation sleep system by separating the water-containing the bladder from the perimeter supporting air chamber (see my U.S. Pat. No. 4,513,463, issued Apr. 30, 1985). By my patented arrangement, bladders or marginal perimeter supporting chambers may be selectively replaced when damaged, or whenever a change in the bladder or chamber characteristics is desired. As with other typical floatation sleep systems including marginal perimeter supporting air chambers however, the side walls of the air chambers are rounded in cross-section due to the nature of the chamber construction and the air pressure therewithin. This has, in some instances, proven to be a drawback to users who prefer the overall rectilinear appearance of conventional bedding. In my U.S. patent application Ser. No. 782,938, filed Oct. 2, 1985, now abandoned, I have attempted to provide such desired rectilinear appearance to marginal perimeter supporting air chambers. However, the chambers disclosed in such application are not individually replaceable when damaged.

SUMMARY OF THE INVENTION

This invention is directed to an improved air chamber for use with a marginal perimeter support adapted to surround and support a fluid-filled bladder of a floatation sleep system. The air chamber comprises an elongated cylinder closed at its ends to form an air-tight chamber. Opposing interior surfaces of the cylinder are interconnected by, for example, tie members extending in a longitudinal direction within said elongated cylinder for less than the full longitudinal dimension of such cylinder. The tie members divide the cylinder into at least three sections located one on top of another, with such sections being in flow intercommunication. Moreover, with this invention, the cross-sectional area of the upper- and lower-most sections may be substantially equal and greater than the cross-sectional area of any intermediate sections. Further, a valve extends through a wall of said elongated cylinder for enabling selective pressurization of the air-tight chamber, whereby under such pressurization the tie members cause the cylinder to assume a substantially rectilinear overall external configuration. A plurality of air chambers can be arranged to form the rectilinear marginal perimeter support for a bladder of a floatation sleep system, with such chambers being readily individually replaced.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
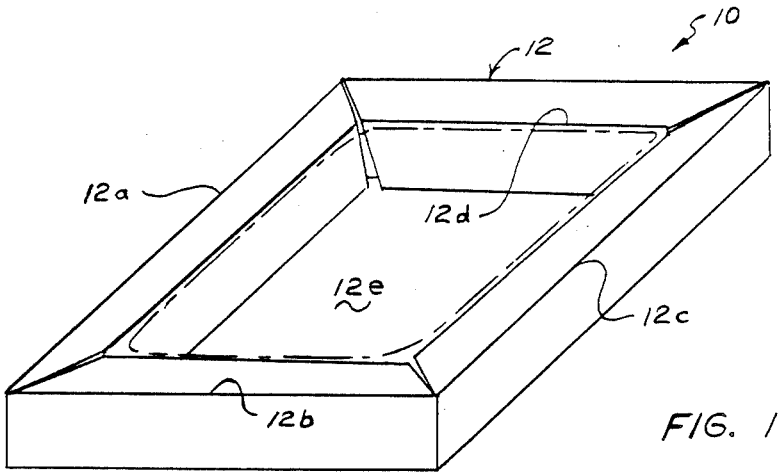
FIG. 1 is a view, in perspective, of a marginal perimeter support, according to this invention, for a fluid-filled bladder of a floatation sleep system.
Figure 2:
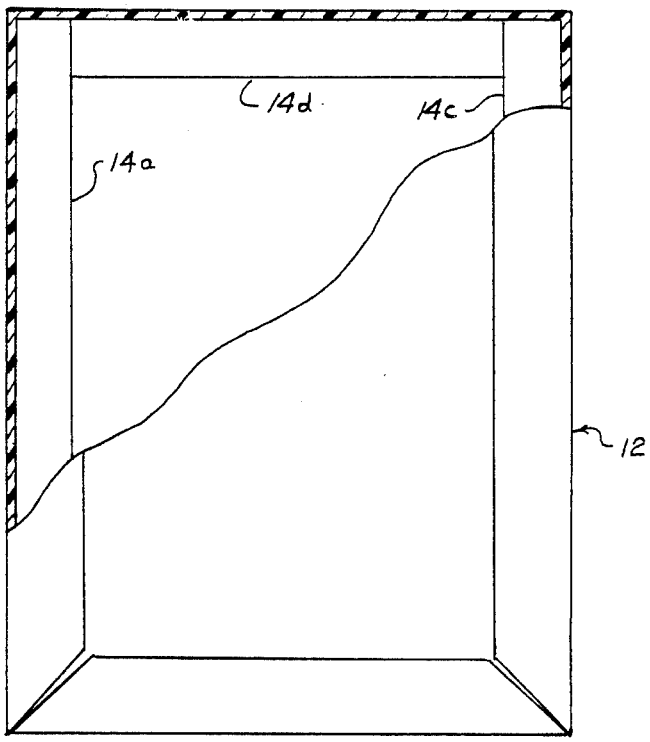
FIG. 2 is a top plan view of the marginal perimeter support of FIG. 1, on an enlarged scale and partially in cross-section to facilitate viewing.
Figure 3:
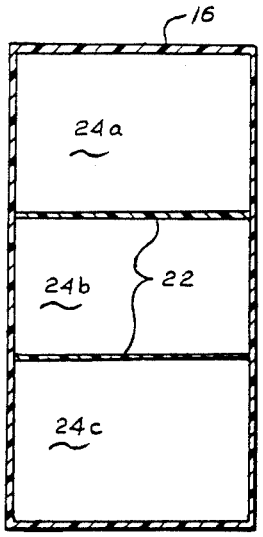
FIG. 3 is an end elevational view, in cross-section and on an enlarged scale, of an improved air cylinder for the marginal perimeter support of FIG. 1.

Referring now to the accompanying drawings, a marginal perimeter support for a floatation sleep system including a fluid-filled bladder is shown in FIGS. 1 and 2, and designated generally by the numeral 10. The support 10 includes a flexible, dimensionally stable sheet 12 of fluid impervious material, such as polyethylene for example. The sheet 12 has a plurality of portions **12*a*–12*d* folded over and sealed to itself to form receptacles for a plurality of air cylinders 14*a*–14*d* respectively, and a chamber 12*e* for receiving an independent fluid-filled bladder (shown in phantom in FIG. 1) of a floatation sleep system. The air cylinders 14*a*–14*d*, constructed according to this invention, enable the marginal perimeter support 10** to have the preferred overall rectilinear shape.

Each of the air cylinders 14a–14d includes an elongated cylindrical tube 16. The tube 16 is formed of a flexible, dimensionally stable material such as polyethylene for example. The ends of the tube 16 are sealed by end caps 18 formed of a similar material to that of the tube in order to facilitate joining together of the tube and end caps, such as by heat sealing for example. Of course other materials and other methods of assembly for the tube and end caps are suitable for use in this invention. The sealing of the tube 16 by the end caps 18 forms an air tight chamber within such tube. A valve 20 is located in one of the end caps (or in a side wall of the tube 16 if preferred) and communicates with the interior chamber formed by the tube and end caps. The valve 20 enables pressurized air to be admitted to the chamber to inflate such chamber.

Figure 4:
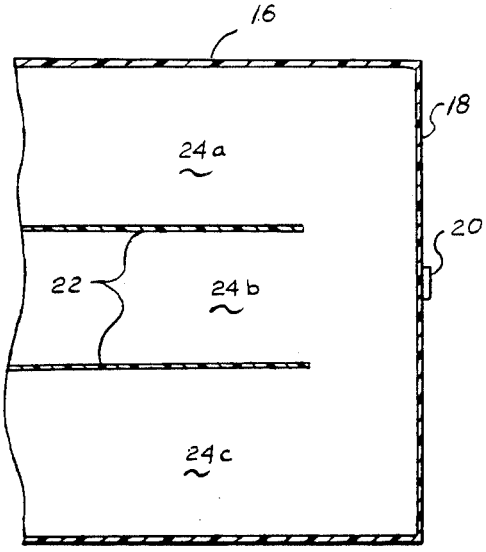
FIG. 4 is a side elvational view, in cross-section of the improved air cylinder of FIG. 3.

The tube 16 further includes a plurality of tie members 22 connected to the interior walls thereof. The tie members 22, which are made of a similar material as that used to form the tube for example, extend in the longitudinal direction of the tube but for less than the full longitudinal dimension of the tube (see FIG. 4). In the preferred embodiment of this invention as shown in the drawings, there are two tie members 22; however other number of tie members are suitable for use with this invention. The tie members 22 interconnect opposing wall portions of the tube 16 to divide the tube into sections 24a–24c, which by virtue of the members extending less than the full longitudinal dimension of the tube, are in flow communication. The location of the tie members 22 is selected such that the cross-sectional area of the upper- and lower-most sections 24a and 24c are substantially equal, and the cross-sectional area of the intermediate section 24b is substantially less than the cross-sectional area of sections 24a and 24c. Although other relationships of the cross-sectional areas are suitable for use with this invention, it has been found that a relationship where the cross-sectional area of the intermediate sections 24b is approximately 50% of the cross-sectional area of the upper- or lower-most sections 24a,24c, results in the tube 16 assuming a substantially rectilinear overall configuration when pressurized. This is because the tie members 22 act to substantially prevent the opposing walls of the tube 16 from moving away from one another under pressure. Accordingly, when a plurality of the air chambers 14a–14d, respectively formed by the tubes 16 constructed as described, are placed in adjacent relation as shown in FIG. 2 within the portions 12a–12d respectively, the overall configuration of the marginal perimeter support 10 is of the desired substantially rectilinear shape, and the air chambers are readily individually replaceable when damaged.

In certain instances, it may be desireable to provide for a flow intercommunication between the air chambers 14a–14d. For example, it may be desired to give the air chamber a "soft" feel to a person sitting thereon. This feel is directly related to the pressure within the air chamber. Therefore, allowing the pressure increase due to the person sitting on the air chamber to be distributed to all the air chambers by their intercommunication softens the feel thereof while still permitting the air chambers to have sufficient pressure to adequately support the marginal perimeter of a fluid-filled floatation sleep system bladder.

Figure 6:
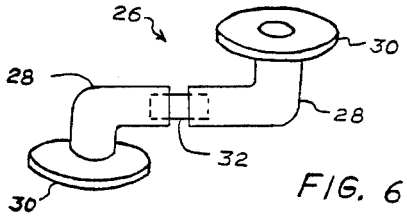
FIG. 6 is a view, in perspective and on an enlarged scale, of the coupling device for providing flow intercommunication between adjacent air cylinders of the marginal perimeter support.
Figure 5:
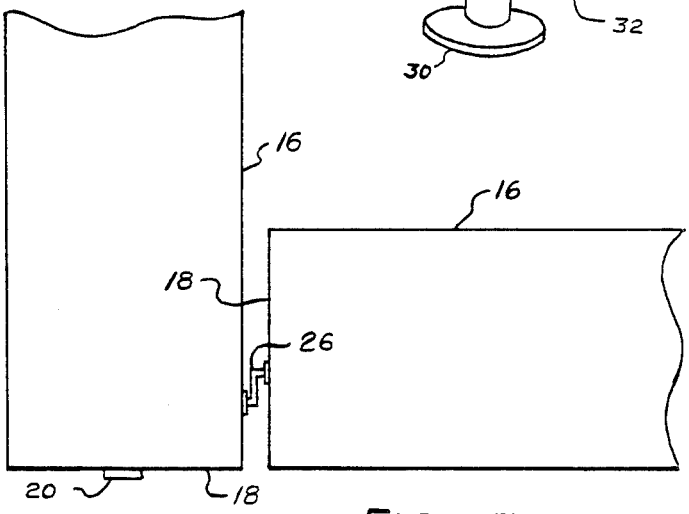
FIG. 5 is a top plan view of a pair of adjacent air cylinders arranged in the marginal perimeter support, particularly showing their flow intercommunication.

The desired interconnection between the adjacent air chambers is provided by a coupling device 26 (see FIGS. 5 and 6). The coupling device 26 includes a substantially "L"-shaped tube 28 and an integral base 30 respectively secured to each tube 16 over a small hole (not shown) through the tube 16. The coupling devices 26 of the tubes 16 of adjacent air chambers are located so that they can be interconnected in pressure equalizing flow relation by a tube 32. When it is desired to seal individual air chambers from one another, the tube 32 can be replaced in each tube 28 respectively by a suitable plug (not shown). Accordingly, the air chambers are then independent of one another and can be individually removed, for example for replacement.

It should of course be understood that while this invention has been described as having four indivdual air cylinders, other number of cylinders are suitable for use with this invention. For example, the air cylinder formed substantially in the manner described above, could be elongated to the extent that, with appropriate constrictions at spaced locations, the cylinder could be folded to completely (or at least partially) surround the perimeter of a fluid-filled bladder. Additionally, the tie members 22 could extend for the entire longitudinal dimension or the tube 16 and connect directly to the end caps 18. Then, intercommunication between the sections of the tube 16 can be provided by including openings through the tie members.

The invention has been described in detail with reference to a preferred embodiment thereof, but it will be understood that variations and modifications can be effected within the spirit and scope of the invention.

I claim:

1. An improved air chamber for use with a marginal perimeter support adapted to surround and support an independent fluid-filled bladder of a floatation sleep system, said air chamber comprising:

an elongated cylinder closed at its ends to form an air-tight chamber; means connected between opposing interior surfaces of said cylinder and extending in a longitudinal direction within said elongated cylinder for dividing said cylinder into at least three sections located one on top of another with said sections being in flow intercommunication and preventing said surfaces from moving away from one another; and means extending through a wall of said elongated cylinder for enabling selective pressurization of said air-tight chamber so that, under such such pressurization, said dividing means cause said cylinder to assume a substantially rectilinear overall external configuration.

2. The invention of claim 1 wherein the cross-sectional areas of the upper- and lower-most of said sections are substantially equal and are greater than the cross-sectional area of any intermediate section.

3. The invention of claim 2 wherein the cross-sectional area of said intermediate section is equal to approximately 50% of the cross-sectional area of said upper- or lower-most section.

4. The invention of claim 1 further including means for enabling said elongated chamber to be selectively coupled in flow intercommunication with another similarly constructed elongated cylinder.

5. In a floatation sleep system including a fluid-filled bladder and an improved independent marginal perimeter support for such bladder, said improved marginal perimeter support comprising:

at least one air chamber; means for selectively retaining said air chamber in supporting relation with the marginal perimeter of said bladder, said air chamber including an elongated cylinder closed at its ends to form an air-tight chamber; means connected between opposing interior surfaces of said cylinder and extending in a longitudinal direction within said elongated cylinder for dividing said cylinder into at least three sections located one on top of another with said sections being in flow intercommunication and preventing said surfaces from moving away from one another; and means extending through a wall of said elongated cylinder for enabling selective pressurization of said air-tight chamber so that, under such such pressurization, said dividing means cause said cylinder to assume a substantially rectilinear overall external configuration.

6. The invention of claim 5 wherein the cross-sectional areas of the upper- and lower-most of said sections are substantially equal and are greater than the cross-sectional area of any intermediate section.

7. The invention of claim 6 wherein the cross-sectional area of said intermediate section is equal to approximately 50% of the cross-sectional area of said upper- or lower-most section.

8. The invention of claim 5 including a plurality of air chambers arranged in respectively adjacent relationship.

9. The invention of claim 8 further including means for enabling adjacent ones of said plurality of elongated chambers to be selectively coupled in flow intercommunication.

10. The invention of claim 9 wherein said coupling means is a tube in flow intercommunication with the interior of one air chamber, a tube in flow intercommunication with an adjacent air chamber, and flow connector means for joining said tubes in flow intercommunication.

11. The invention of claim 10 wherein said connector means can be removed and replaced, in each tube, with plugs to isolate the respective adjacent air chambers.

* * * * *